US007442097B2

(12) United States Patent
Kumakura

(10) Patent No.: US 7,442,097 B2
(45) Date of Patent: Oct. 28, 2008

(54) METHOD FOR FORMING A TERMINAL METAL AND TERMINAL METAL FORMED BY THE METHOD

(75) Inventor: Hideto Kumakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/972,241

(22) Filed: Jan. 10, 2008

(65) Prior Publication Data

US 2008/0139056 A1 Jun. 12, 2008

Related U.S. Application Data

(62) Division of application No. 11/363,196, filed on Feb. 28, 2006, now Pat. No. 7,338,334.

(30) Foreign Application Priority Data

Feb. 28, 2005 (JP) ..... P2005-052473
Mar. 23, 2005 (JP) ..... P2005-083181

(51) Int. Cl.
*H01R 4/10* (2006.01)

(52) U.S. Cl. ..... 439/866; 439/879; 29/851; 29/876

(58) Field of Classification Search ..... 439/866, 439/879; 29/851, 876
See application file for complete search history.

(56) References Cited

U.S. PATENT DOCUMENTS 2,806,215 A * 9/1957 Redslob ..... 439/868
3,568,137 A * 3/1971 Youngblut et al. ..... 439/865
5,340,337 A 8/1994 Pentz
5,399,110 A 3/1995 Morello et al.
5,433,629 A 7/1995 Yagi et al.
5,675,891 A 10/1997 Childs et al.
6,375,518 B2 4/2002 Sato
7,338,334 B2 * 3/2008 Kumakura ..... 439/866
2006/0205289 A1 9/2006 Kumakura
2008/0139056 A1 * 6/2008 Kumakura ..... 439/866

FOREIGN PATENT DOCUMENTS

JP 8-162191 A 6/1996
JP 2002-63961 A 2/2002
JP 2003-115340 A 4/2003
JP 2003-217698 A 7/2003
JP 2004-193073 A 7/2004

* cited by examiner

*Primary Examiner*—James Harvey
(74) *Attorney, Agent, or Firm*—Sughrue Mion, PLLC

(57) ABSTRACT

A male contact portion, a female contact portion, a clamp portion where an electric wire is clamped for connection, a crimp portion where an electric wire is crimped and a piercing portion where an electric wire is pierced to be crimped are formed separately, whereby one of the male contact portion and the female contact portion is selected according to an application and one of the clamp portion, the crimp portion and the piercing portion is selected according to the application, and a connecting portion of the selected electric contact part and a connecting portion of the selected wire connection part are superposed on each other so as to join the selected electric contact making point and the selected wire connection part together.

4 Claims, 14 Drawing Sheets

METHOD FOR FORMING A TERMINAL METAL AND TERMINAL METAL FORMED BY THE METHOD

This is a divisional of application Ser. No. 11/363,196 filed Feb. 28, 2006. The entire disclosure of the prior application, application Ser. No.(s) 11/363,196 is considered part of the disclosure of the accompanying divisional application and is hereby incorporated by reference.

BACKGROUND OF THE INVENTION

1. Field of the Invention

The present invention relates to a method for forming a terminal metal used in a wiring harness and a terminal metal formed by the method.

2. Related Art

Various types of electronic appliances are installed on an automobile as a mobile body. Wiring harnesses are laid out on the automobile for supplying power and transmitting control signals to the electronic appliances so installed. The wiring harnesses each include a plurality of electric wires and a plurality of connectors. The electric wires are so-called covered wires each made up of a conductive core wire and an insulating coating portion which covers the core wire.

The connectors each include a pair of insulating connector housings which are fitted together and conductive terminal metals which are housed in those housings. The terminal metals each include a wire connection part which is attached to an end portion of the electric wire so as to make an electric connection with the core wire at one end and at the other end thereof an electric contact part which is brought into contact with a mating terminal metal. The wiring harness transmits control signals and the like to the electronic appliance when the corresponding connector housings of the connector therefor are connected together.

In a wiring harness production process, terminal metals which are different in the shape of wire connection parts are selected to be used according to connection treatment methods and types of electric wires, and there exist, as these terminal metals, for example, a terminal metal having a clamp portion where a core wire of an electric wire which is exposed by stripping off a coating portion thereof is clamped (hereinafter, referred to a clamp terminal as shown in JP-A-2004-193073), a terminal metal having a crimp portion where a coating portion of an electric wire is cut for contact with a core wire therein (hereinafter, referred to as a crimp terminal as shown in JP-A-2003-217698), and a terminal metal having a piercing portion where a flat cable is pierced for contact with a core wire therein (hereinafter, referred to as a piercing contact as shown in JP-A-2003-115340).

Note that a connection using the clamp terminal is suitable for connection of a power supply cable which requires a high connecting reliability, and a connection using the crimp terminal is suitable for automation of a production process. In addition, a connection using the piercing contact is suitable for connection of a flat cable and has an advantage that the wiring space can be reduced.

Furthermore, in each of these terminal metals, there exist a terminal metal having a male electric contact part (hereinafter, referred to as a male contact portion as shown in JP-A-8-162191) and a terminal metal having a female electric contact part (hereinafter, referred to as a female contact portion as shown JP-A-2-2-63961). A male contact portion of one terminal metal is accommodated in a female contact portion of the other terminal metal, whereby an electric connection is established therebetween. In addition, in order to maintain a fitting compatibility, the male contact portion and the female contact portion are formed into the same shapes even in terminal metals which differ in type of wire connection parts.

The conventional terminal metals are formed by bending sheets metal obtained by stamping conductive sheets metal with dies prepared under product numbers allocated for the respective terminal metals. The wire connection part and the electric contact part are integrally formed. Namely, since parts of the same shape are formed with different dies, there are caused problems that variation in performance is generated among the parts due to manufacturing tolerance of the shape, and that there are formed wasteful dies for forming parts of the same shape.

SUMMARY OF THE INVENTION

Therefore, an object of the invention is to provide a terminal metal which is inexpensive and is free from variation to thereby exhibit a stable performance, and a method for forming the same terminal metal.

With a view to attaining the object, according to a first aspect of the invention, there is provided a manufacturing method of a terminal metal comprising a wire connection part to which an electric wire is connected and an electric contact part which is electrically connected to a mating terminal metal, comprising the steps of:

forming separately a wire connection part and an electric contact part; and fitting said wire connection part and said electric contact part to each other, so that the terminal metal is formed, wherein said wire connection part is selected from plural types of parts, and the selected wire connection part is joined to said electric contact part.

According to the invention, said wire connection part may include a clamp portion where an electric wire is clamped, a crimp portion where an electric wire is crimped and a piercing portion where an electric wire is pierced to be crimped.

According to the invention, said electric contact part may be selected from plural types of parts, and the selected wire connection part may be joined to the selected electric contact part.

According to the invention, said wire connection part and said electric wire part may be joined to each other by crimping a piecing piece that is provided in one of said wire connection part and said electric wire part.

According to the another aspect of the invention, there is provided a terminal metal comprising:

a wire connection part to which an electric wire is connected; and an electric contact part which is electrically connected to a mating terminal metal;

wherein said wire connection part and said electric contact part are separately formed and joined to each other;

wherein said wire connection part is selected from plural types of parts capable of being fitted to the electric contact part, and the selected wire connection part is joined to the electric contact part.

According to the invention, since parts can be shared between terminal metals that are to be formed under different product numbers, the minimization of variation in performance due to interchange caused for each part can be attained, and the parts costs for respective constituent parts of terminal metals can be reduced by virtue of mass production effect. Furthermore, before the electric contact parts and the wire connection parts are assembled together, work can be done only on the wire connection parts, thereby making it possible to prevent the failure and deformation of the electric contact parts during a wiring harness production process.

According to the terminal metals of the invention, since parts can be shared between terminal metals that are to formed under different product numbers, the minimization of variation in performance due to interchange caused for each part can be attained, and the parts costs for respective constituent parts of terminal metals can be reduced by virtue of mass production effect. Furthermore, before the electric contact parts and the wire connection parts are assembled together, work can be done only on the wire connection parts, thereby making it possible to prevent the failure and deformation of the electric contact parts during a wiring harness production process.

DETAILED DESCRIPTION OF THE PREFERRED EMBODIMENTS

First Embodiment

Hereinafter, a terminal metal and a method for forming the terminal metal according to a first embodiment of the invention will be described by reference to FIGS. 1A to 7. The terminal metal manufacturing method according to the first embodiment is a method for forming a terminal metal such as a clamp terminal 1A (shown in FIGS. 1A and 1B) having a male electric contact part (hereinafter, referred to as a male contact portion) 10, a crimp terminal 1B (shown in FIGS. 2A and 2B) having the male contact portion 10 and a piercing terminal 1C (shown in FIGS. 3A and 3B) having the male contact portion 10, and a terminal metal such as a clamp terminal 2A (shown in FIGS. 4A and 4B) having a female electric contact part (hereinafter, referred to as a female contact portion) 20, a crimp terminal 2B (shown in FIGS. 5A and 5B) having the female contact portion 20 and a piercing terminal 2C (shown in FIGS. 6A and 6B) having the female contact portion 20.

The terminal metals 1A, 1B, 1C, 2A, 2B, 2C are housed within connector housings, not shown, which are made of insulating synthetic resin for use in electrically connecting together a terminal metal housed within a mating connector housing and an electric wire, not shown. In addition, when used in this specification, the electric wire denotes a so-called covered wire of a circular cross section in which a core wire made of a conductive metal is covered with an insulating synthetic resin and a flat covered wire (a flat circuit unit) such as a known flexible flat cable (hereinafter, referred to as an FFC).

Figure 1A:
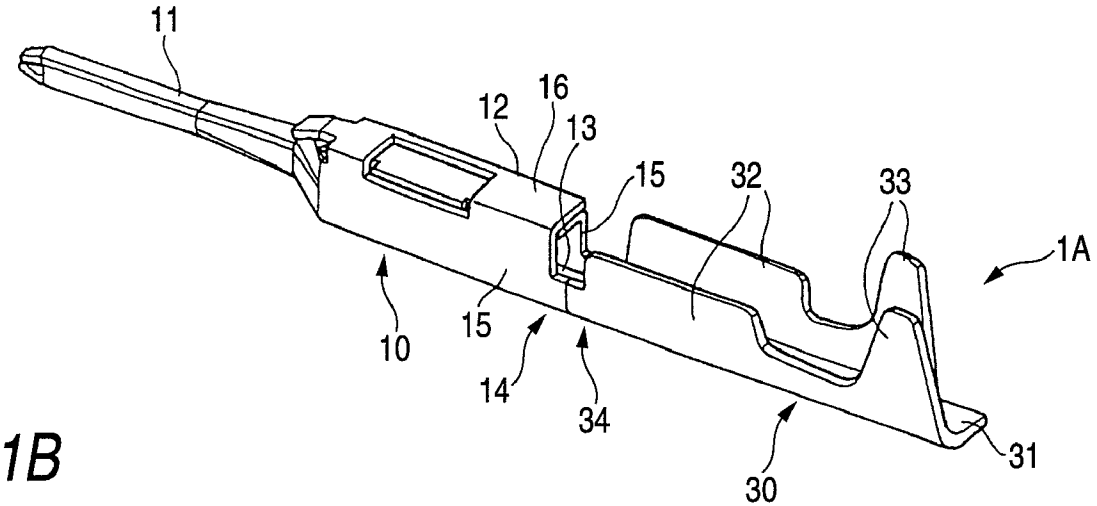
FIG. 1A is a perspective view which shows a clamp terminal having a male contact portion according to a first embodiment of the invention.

As shown in FIG. 1A, the clamp terminal 1A includes a clamp portion 30 as a wire connection part where an electric wire is connected electrically and a male contact portion 10.

Figure 1B:
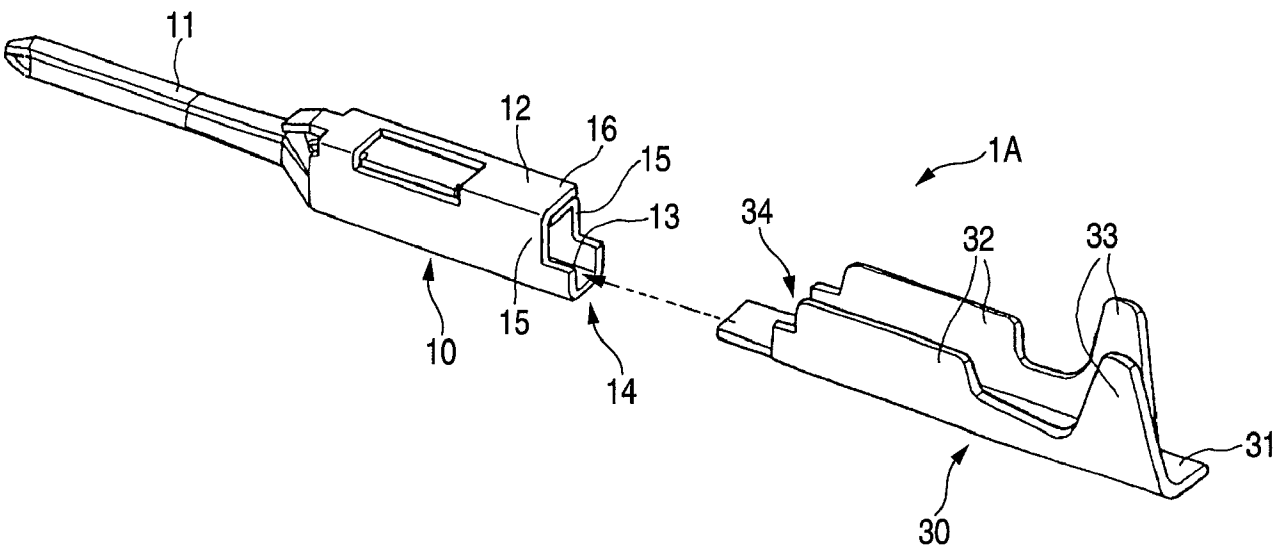
FIG. 1B is an exploded perspective view of the clamp terminal shown in FIG. 1A.

The male contact portion 10 is made of a conductive metal or the like, is formed separately from the clamp portion 30, as shown in FIGS. 1A and 1B and includes an insertion element 11 which is inserted into a female contact portion housed in a mating terminal metal and a main body portion 12.

The main body portion 12 is formed into a hollow prism shape which is made up of four side walls such as a bottom wall 13, side walls 15, 15 provided so as to erect from the bottom wall 13 along longitudinal edges thereof, and a ceiling or top wall 16 provided continuously to the side walls 15, 15 and spaced apart from the bottom wall 13 at a certain interval. The main body portion 12 continues to the insertion element 11 at one longitudinal end portion thereof and has a connecting portion 14 provided on the bottom wall 13 at the other longitudinal end portion thereof. The main body portion 12 is connected to a connecting portion 34 of the clamp portion 30, which will be described later on, at the connecting portion 14.

The insertion element 11 continues to the main body portion 12 and is formed into a thin and elongated prism shape. The insertion element 11 is formed thinner than the main body portion 12. The insertion element 11 is inserted into a female contact portion of a mating terminal metal so as to make an electric connection with the mating terminal metal.

The clamp portion 30 is made of a conductive metal or the like and includes, as shown in FIGS. 1A and 1B, a bottom wall 31, a pair of core wire clamping pieces 32, 32 provided so as to erect from the bottom wall 31 partially along longitudinal edges thereof and a pair of coating portion clamping pieces 33, 33 provided so as to erect from the bottom wall 31 partially along the longitudinal edges thereof and lying farther apart from the male contact portion 10 than the pair of core wire clamping pieces 32, 32.

In the clamp portion 30, after a round electric wire whose coating is stripped off at one end portion thereof so as to expose a core wire therein is placed on the bottom wall 31, the core wire clamping pieces 32, 32 are folded in such directions as to clamp the core wire portion of the electric wire against the bottom wall 31, that is, the core wire portion of the electric wire is clamped with the core wire clamping pieces 32, 32, whereby the clamp portion 30 is electrically connected with the electric wire. In addition, in a similar way, the coating portion clamping pieces 33, 33 are folded in such directions as to clamp a coating portion of the electric wire against the bottom wall 31, that is, the coating portion of the electric wire is clamped with the coating portion clamping pieces 33, 33, whereby the electric wire is fixed to the clamp portion 30.

The clamp portion 30 further includes a connecting portion 34. The connecting portion 34 is provided on an end of the bottom wall 31 which adjoins the core wire clamping pieces 32 and extends longitudinally from the bottom wall 31.

In the clamp terminal 1A, as shown in FIG. 1B, the connecting portion 34 provided on the longitudinal end portion of the clamp portion 30 which adjoins the core wire clamping pieces 32, 32 is superposed on the bottom wall 13 of the main body portion 12 at the other end portion thereof, that is, on the connecting portion 14 of the main body portion 12, whereby the male contact portion 10 and the clamp portion 30 are connected to each other. Thus, in the clamp terminal 1A, the insertion element 11, the main body portion 12 and the clamp portion 30 are aligned in a row in that order.

Figure 2A:
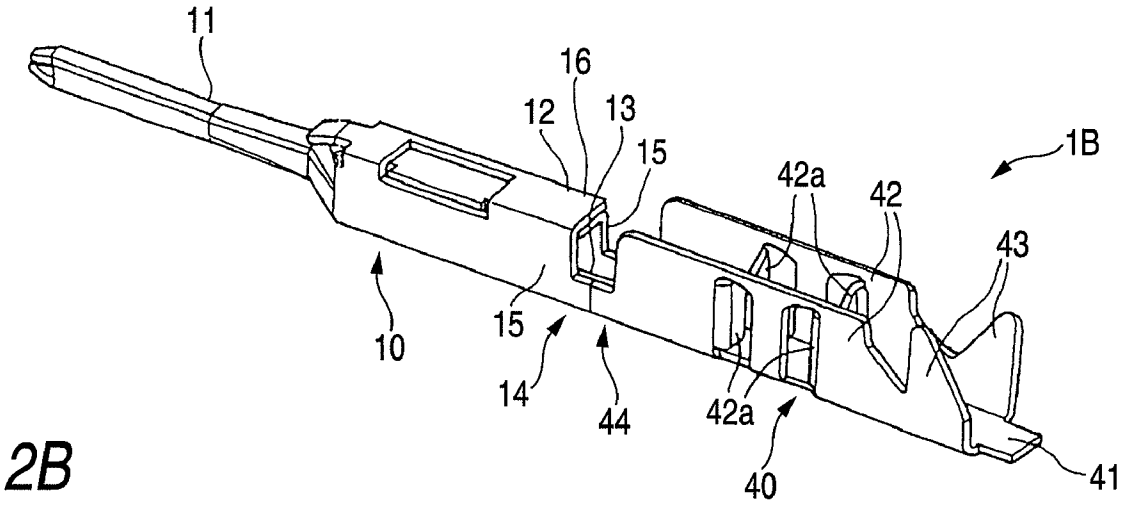
FIG. 2A is a perspective view which shows a crimp terminal having a male contact portion according to the first embodiment of the invention.

The crimp terminal 1B includes, as shown in FIG. 2A, a press connecting portion 40 as a wire connection part where an electric wire is connected electrically and a male contact portion 10. The same male contact portion as the male contact portion 10 of the clamp terminal 1A is used as the male contact portion 10. Note that like reference numerals will be imparted to like constituent portions to those of the clamp terminal 1A shown in FIGS. 1A and 1B, and the description thereof will be omitted.

The male contact portion 10 is connected to a connecting portion 44 of the crimp portion 40, which will be described later on, at a connecting portion 14 thereof which is provided the other longitudinal end portion of a main body portion 12.

Figure 2B:
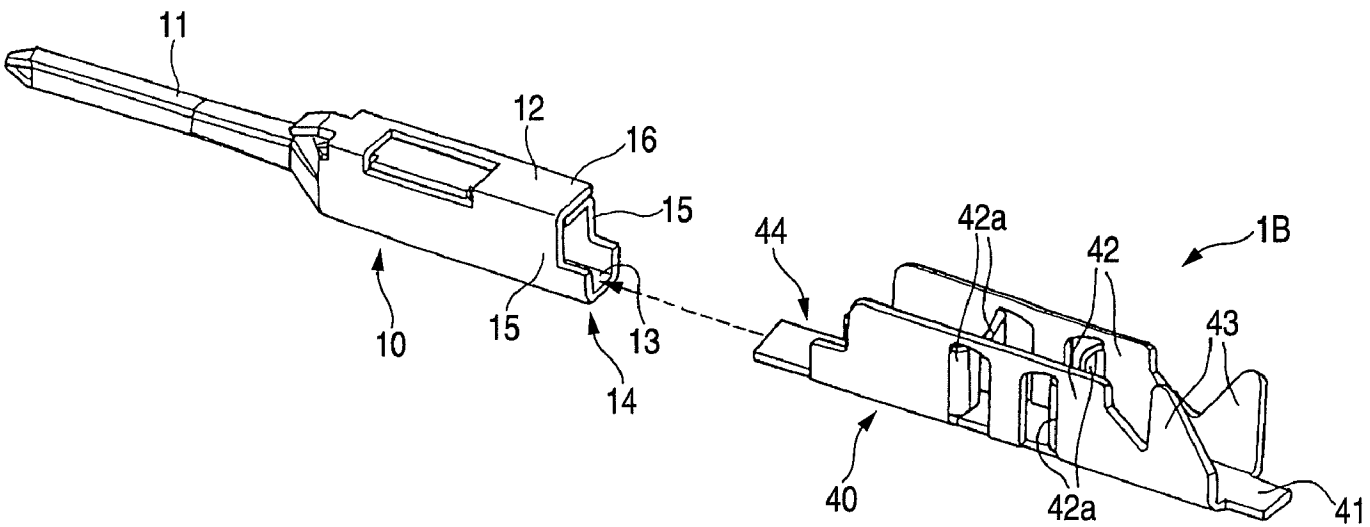
FIG. 2B is an exploded perspective view of the crimp terminal shown in FIG. 2A.

The crimp portion 40 is made of a conductive metal or the like and includes, as shown in FIGS. 2A and 2B, a bottom wall 41, a pair of pressure connecting pieces 42, 42 provided so as to erect from the bottom wall 41 partially along longitudinal edges thereof and a pair of clamping pieces 43, 43 provided so as to erect from the bottom wall 41 partially along the longitudinal edges thereof and lying farther apart from the male contact portion 10 than the pair of pressure connecting pieces 42, 42. The pressure connecting pieces 42, 42 each have a plurality of pressure connecting blades 42*a*. The pressure connecting blades 42*a* are cut in and erected from the pressure connecting pieces 42 and are arranged in a direction which intersects a longitudinal direction of the crimp portion 40.

In the crimp portion 40, an end portion of a round electric wire is press fitted between the pressure connecting pieces 42, 42, and as this occurs, the press connecting blades 42*a* but into a coating portion of the electric wire so as to come into contact with a core wire, whereby the press connecting portion 40 is electrically connected with the electric wire. In addition, the clamping pieces 43, 43 are folded in such directions as to clamp the electric wire against the bottom wall 41, that is, the electric wire is clamped with the clamping pieces 43, 43, whereby the electric wire is fixed to the crimp portion 40.

The crimp portion 40 includes further a connecting portion 44. The connecting portion 44 is provided at an end of the bottom wall 41 which adjoins the pressure connecting pieces 42 and extends longitudinally from the bottom wall 41.

In the crimp terminal 1B, as shown in FIG. 2B, the connecting portion 44 provided on the longitudinal end portion of the crimp portion 40 which adjoins the pressure connecting pieces 42, 42 is superposed on a bottom wall 13 of the main body portion 12 at the longitudinal other end portion thereof, that is, on the connecting portion 14 of the main body portion 12, whereby the male contact portion 10 and the crimp portion 40 are connected to each other. Thus, in the crimp terminal 1B, an insertion element 11, the main body portion 12 and the crimp portion 40 are aligned in a row in that order.

Figure 3A:
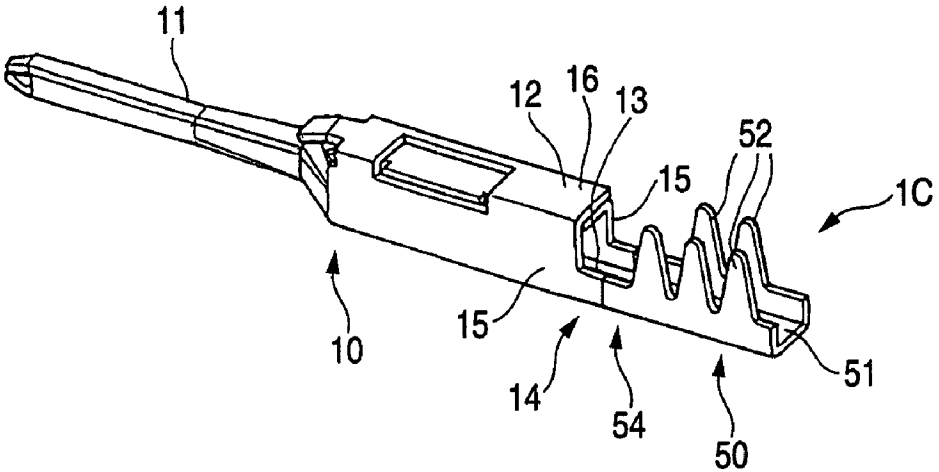
FIG. 3A is a perspective view which shows a piercing terminal having a male contact portion according to the first embodiment of the invention.

The piercing terminal 1C includes, as shown in FIG. 3A, a piercing portion 50 as a wire connection part where an electric wire is connected electrically and a male contact portion 10. The same male contact portion as the male contact portion 10 of the clamp terminal 1A is used as the male contact portion 10. Note that like reference numerals will be imparted to like constituent portions to those of the clamp terminal 1A shown in FIGS. 1A and 1B, and the description thereof will be omitted.

The male contact portion 10 is connected to a connecting portion 54 of the piercing portion 50, which will be described later on, at a connecting portion 14 thereof which is provided the other longitudinal end portion of a main body portion 12.

Figure 3B:
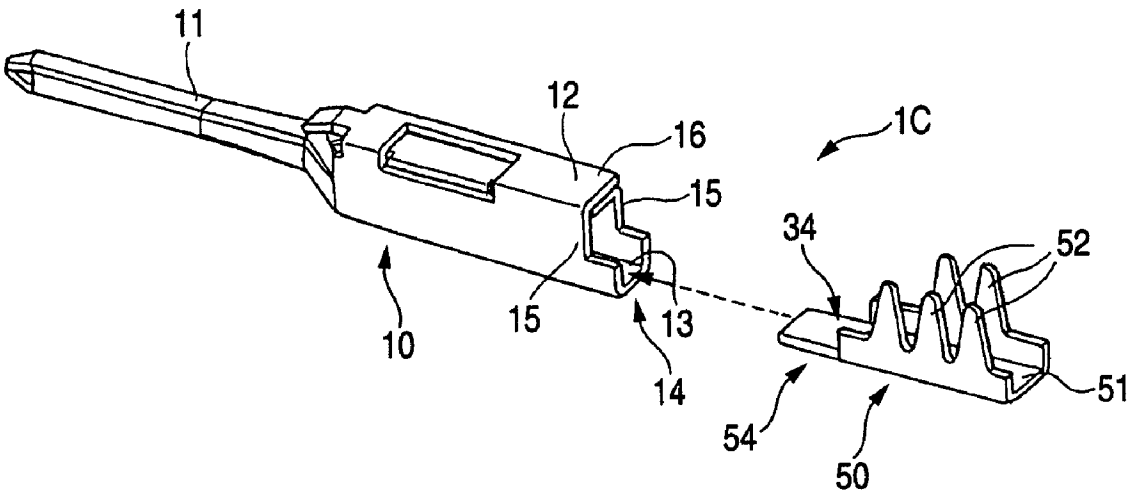
FIG. 3B is an exploded perspective view of the piercing terminal shown in FIG. 3A.

The piercing portion 50 is made of a conductive metal or the like and includes, as shown in FIGS. 3A and 3B, a bottom wall 51 and a plurality of piercing pieces 52 provided so as to erect from the bottom wall 51 along longitudinal edges thereof. The plurality of piercing pieces 52 are arranged along a longitudinal direction of the piercing portion 50, and the oppositely facing piercing pieces 52 are disposed in such a manner as not to face each other directly but in a zigzag fashion.

In the piercing portion 50, the plurality of piercing pieces 52 penetrate (in a tearing fashion) a flat cable such as an FFC so as to come into contact with a conductor therein, whereby the piercing portion 50 is electrically connected with the flat cable. Furthermore, distal end portions of the piercing pieces 52 which have penetrated the flat cable are folded inwardly towards each other, whereby the piercing portion 50 is mechanically connected with the flat cable (clamps the flat cable).

The piercing portion 50 includes further a connecting portion 54. The connecting portion 54 is provided at a longitudinal end portion of the bottom wall 51 and extends longitudinally from the bottom wall 51.

In the piercing terminal 1C, as shown in FIG. 3B, the connecting portion 54 provided on the longitudinal end portion of the piercing portion 50 is superposed on a bottom wall 13 of the main body portion 12 at the other end portion thereof, that is, on the connecting portion 14 of the main body portion 12, whereby the male contact portion 10 and the piercing portion 50 are connected to each other. Thus, in the piercing terminal 1C, an insertion element 11, the main body portion 12 and the piercing portion 50 are aligned in a row in that order.

Figure 4A:
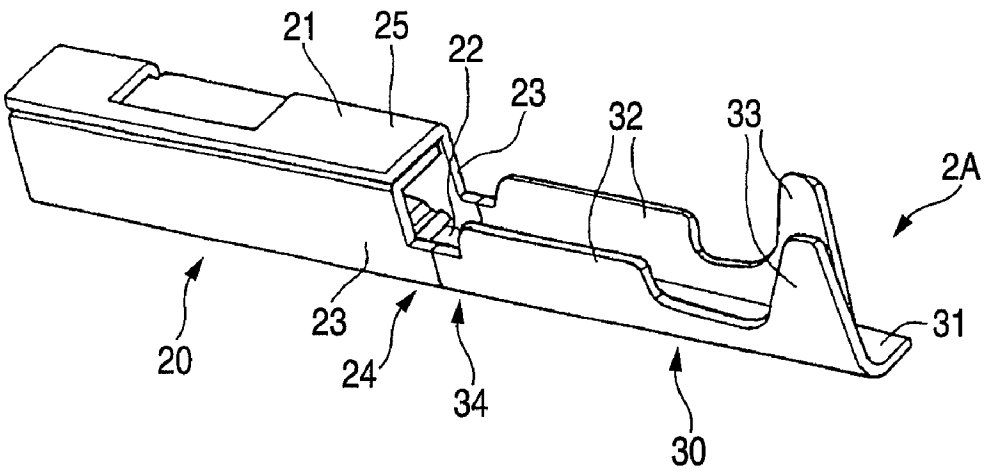
FIG. 4A is a perspective view which shows a clamp terminal having a female contact portion according to the first embodiment of the invention.

The clamp terminal 2A includes, as shown in FIG. 4A, a clamp portion 30 as a wire connection part where an electric wire is connected electrically and a female contact portion 20. The same clamp portion as the clamp portion 30 of the clamp terminal 1A is used as the clamp portion 30. Note that like reference numerals will be imparted to like constituent portions to those of the clamp terminal 1A shown in FIGS. 1A and 1B, and the description thereof will be omitted.

Figure 4B:
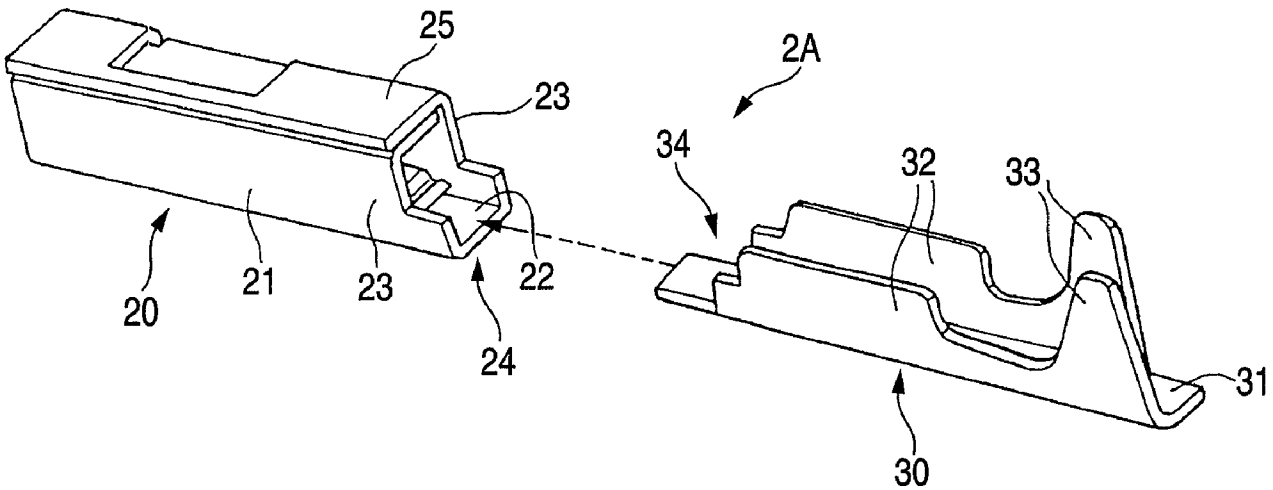
FIG. 4B is an exploded perspective view of the clamp terminal shown in FIG. 4A.

The female contact portion 20 is made of a conductive metal or the like and includes, as shown in FIGS. 4A and 4B, a tubular portion 21 which is formed separately from the clamp portion 30 and is adapted to accommodate therein an insertion element of a mating terminal metal and a spring piece, not shown.

The tubular portion 21 is formed into a hollow prism shape which is made up of four side walls such as a bottom wall 22, side walls 23, 23 provided so as to erect from the bottom wall 22 along longitudinal edges thereof, and a ceiling or top wall 25 provided continuously to the side walls 23, 23 and spaced apart from the bottom wall 22 at a certain interval. The tubular portion 21 has an opening at a longitudinal end portion, and the insertion element of the mating terminal metal is inserted into the tubular portion 21 from the opening. In addition, the spring piece biases the insertion element so inserted towards an inner surface of the tubular portion 21, whereby the female contact portion 20 and the mating terminal metal are electrically connected to each other. The tubular portion 21 includes further a connecting portion 24 on the bottom wall 22 at the other longitudinal end portion thereof.

In the clamp terminal 2A, as shown in FIG. 4B, a connecting portion 34 of the clamp portion 30 is superposed on the bottom wall 22 at the other longitudinal end portion of the tubular portion 21, that is, on the connecting portion 24, whereby the female contact portion 20 and the clamp portion 30 are connected together.

Figure 5A:
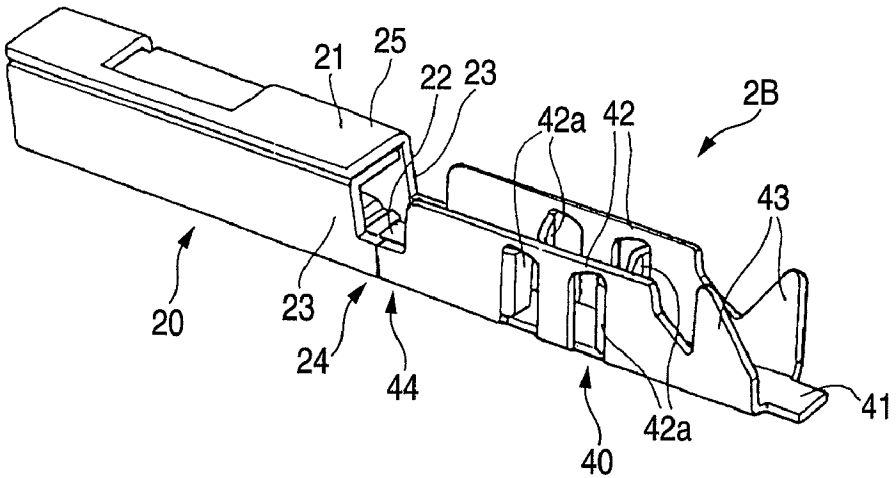
FIG. 5A is a perspective view which shows a crimp terminal having a female contact portion according to the first embodiment of the invention.

The crimp terminal 2B includes, as shown in FIG. 5A, a crimp portion 40 as a wire connection part where an electric wire is connected electrically and a female contact portion 20. The same female contact portion as the female contact portion 20 of the clamp terminal 2A is used as the female contact portion 20, and the same crimp portion as the crimp portion 40 of the pressure terminal 1B is used as the crimp portion 40. Note that like reference numerals will be imparted to like constituent portions to those of the clamp terminal 2A shown in FIGS. 4A and 4B and the clamp terminal 1B shown in FIGS. 2A and 2B, and the description thereof will be omitted.

Figure 5B:
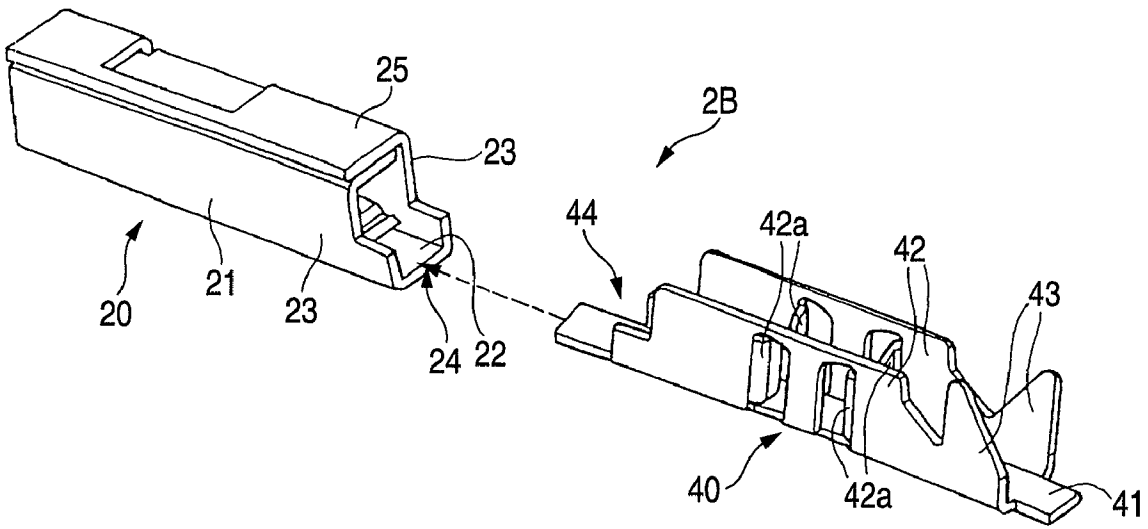
FIG. 5B is an exploded perspective view of the crimp terminal shown in FIG. 5A.

In the crimp terminal 2B, as shown in FIG. 5B, a connecting portion 44 of the crimp portion 40 is superposed on a bottom wall 22 at the other longitudinal end portion of a tubular portion 21, that is, on a connecting portion 24, whereby the female contact portion 20 and the crimp portion 40 are connected together.

Figure 6A:
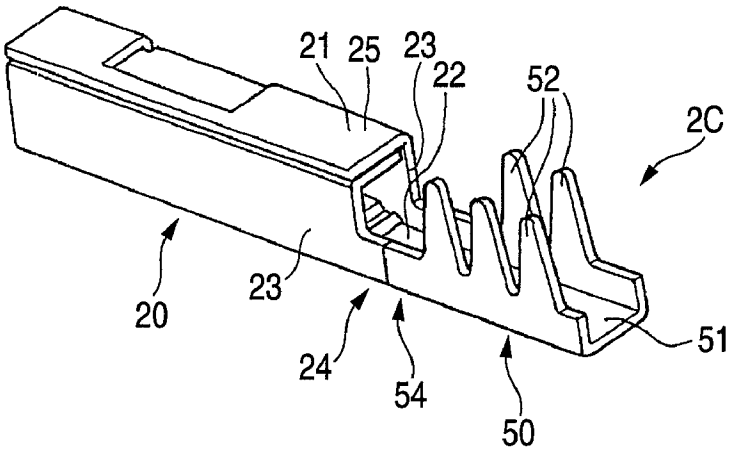
FIG. 6A is a perspective view which shows a piercing terminal having a female contact portion according to the first embodiment of the invention.

The piercing terminal 2C includes, as shown in FIG. 6A, a piercing portion 50 as a wire connection part where an electric wire is connected electrically and a female contact portion 20. The same female contact portion as the female contact portion 20 of the clamp terminal 2A is used as the female contact portion 20, and the same piercing portion as the piercing portion 50 of the piercing terminal 1C is used as the piercing portion 50. Note that like reference numerals will be imparted to like constituent portions to those of the clamp terminal 2A shown in FIGS. 4A and 4B and the piercing terminal 1C shown in FIGS. 3A and 3B, and the description thereof will be omitted.

Figure 6B:
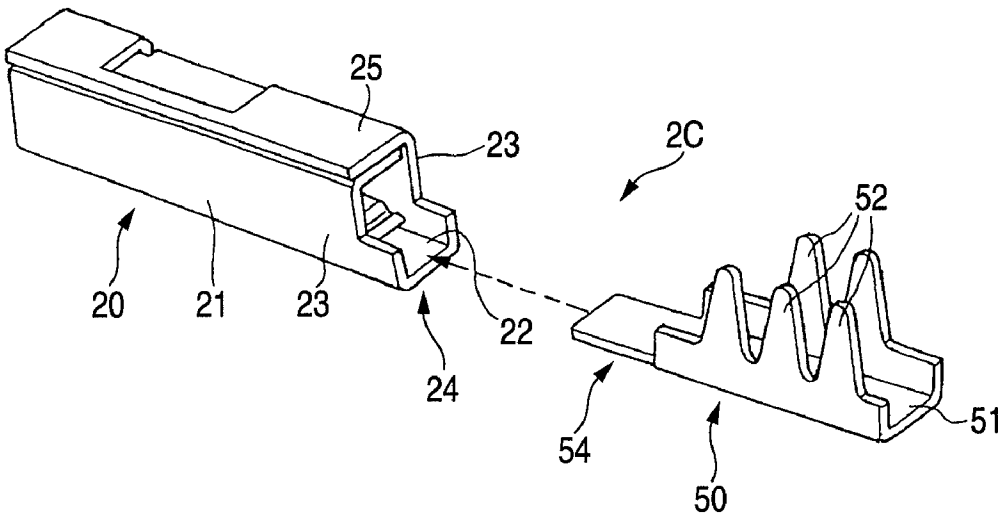
FIG. 6B is an exploded perspective view of the piercing terminal shown in FIG. 6A.

In the piercing terminal 2C, as shown in FIG. 6B, a connecting portion 54 of the piercing portion 50 is superposed on a bottom wall 22 at the other longitudinal end portion of a tubular portion 21, that is, on a connecting portion 24, whereby the female contact portion 20 and the piercing portion 50 are connected together.

Figure 7:
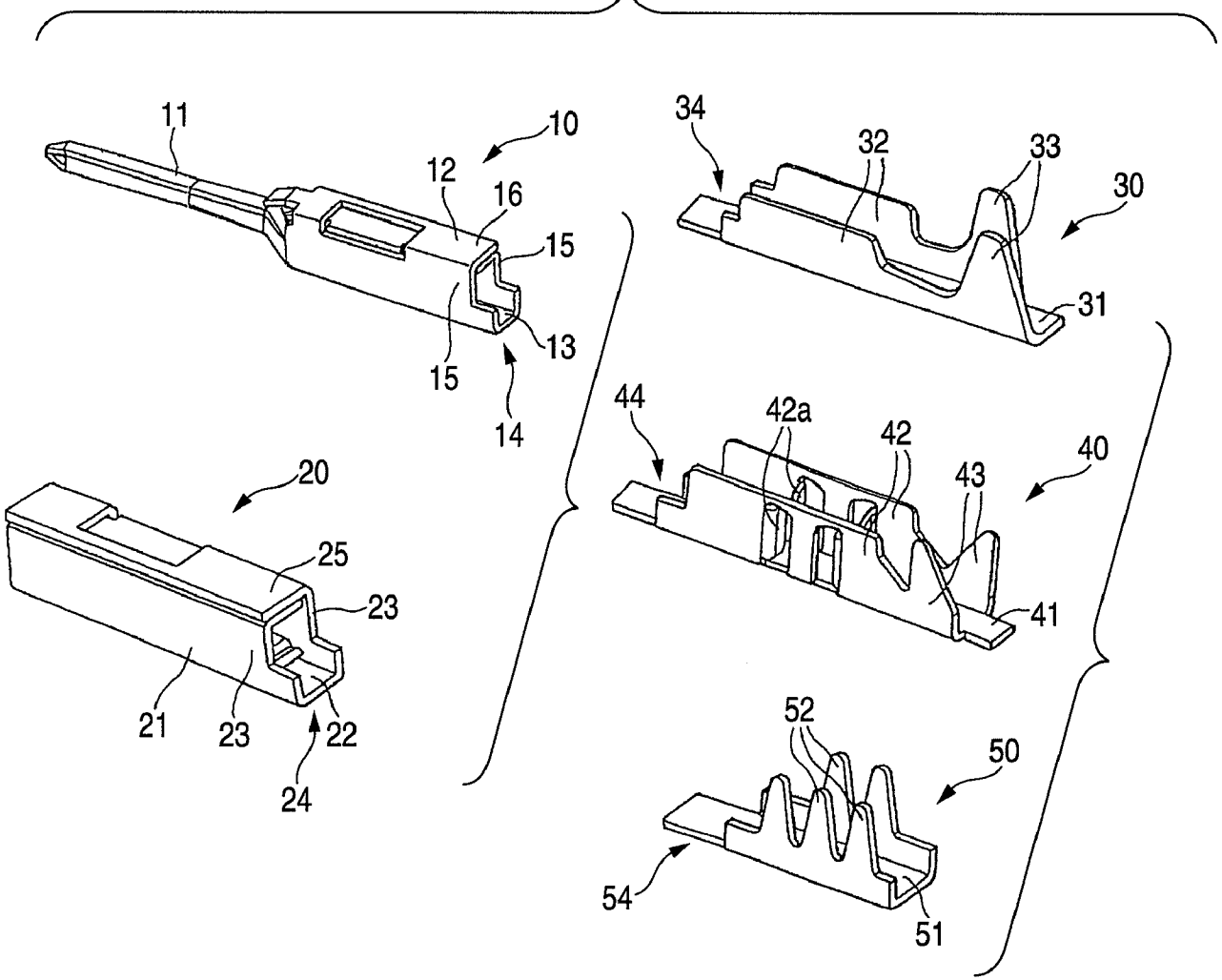
FIG. 7 is a perspective view which explains a method for forming the terminal metals shown in FIGS. 1A to 6B.

A method will be described for forming the terminal metals 1A, 1B, 1C, 2A, 2B, and 2C. Firstly, as shown in FIG. 7, the male contact portion 10, the female contact portion 20, the clamp portion 30, the crimp portion 40 and the piercing portion 50 are formed separately from each other. These are formed by bending sheets metal obtained by stamping conductive sheets metal with dies.

Next, one of the male contact portion 10 and the female contact portion 20 and one of the clamp portion 30, the crimp portion 40 and the piercing portion 50 are selected according to an application, and the selected electric contact part 10, 20 and the selected connecting portion 30, 40, 50 are connected together by superposing the connecting portion 14, 24 of the selected electric contact part 10, 20 and the connecting portion 34, 44, 54 of the wire connection part 30, 40, 50. For example, an ultrasonic bonding method, a spot welding method and the like are adopted as a connecting method for connecting the electric contact part 10, 20 and the wire connection part 30, 40, 50 together. Thus, the terminal metals 1A, 1B, 1C, 2A, 2B and 2C of the first embodiment are formed.

In addition, the connecting treatment for connecting together the electric contact part 10, 20 and the wire connection part 30, 40, 50 may be performed after the wire connection part 30, 40, 50 has been connected to an electric wire or before the wire connection part 30, 40, 50 is connected to an electric wire. The failure and deformation of the electric contact part 10, 20 which would occur when an electric wire and the wire connection part 30, 40, 50 are connected together during a wiring harness production process can be prevented by performing the connecting treatment after the electric wire has been connected to the wire connection part 30, 40, 50.

Thus, according to the terminal metals 1A, 1B, 1C, 2A, 2B, 2C and the method for forming the terminal metals 1A, 1B, 1C, 2A, 2B, 2C of the first embodiment, since the parts 10, 20, 30, 40, 50 which make up the terminal metals 1A, 1B, 1C, 2A, 2B, 2C which are to be formed under different product numbers can be shared between the terminal metals 1A, 1B, 1C, 2A, 2B, 2C, the variation in performance inherent in the conventional terminal metals can be minimized, and the production costs of the terminal metals 1A, 1B, 1C, 2A, 2B, 2C can be reduced by virtue of mass production effect.

Figure 8:
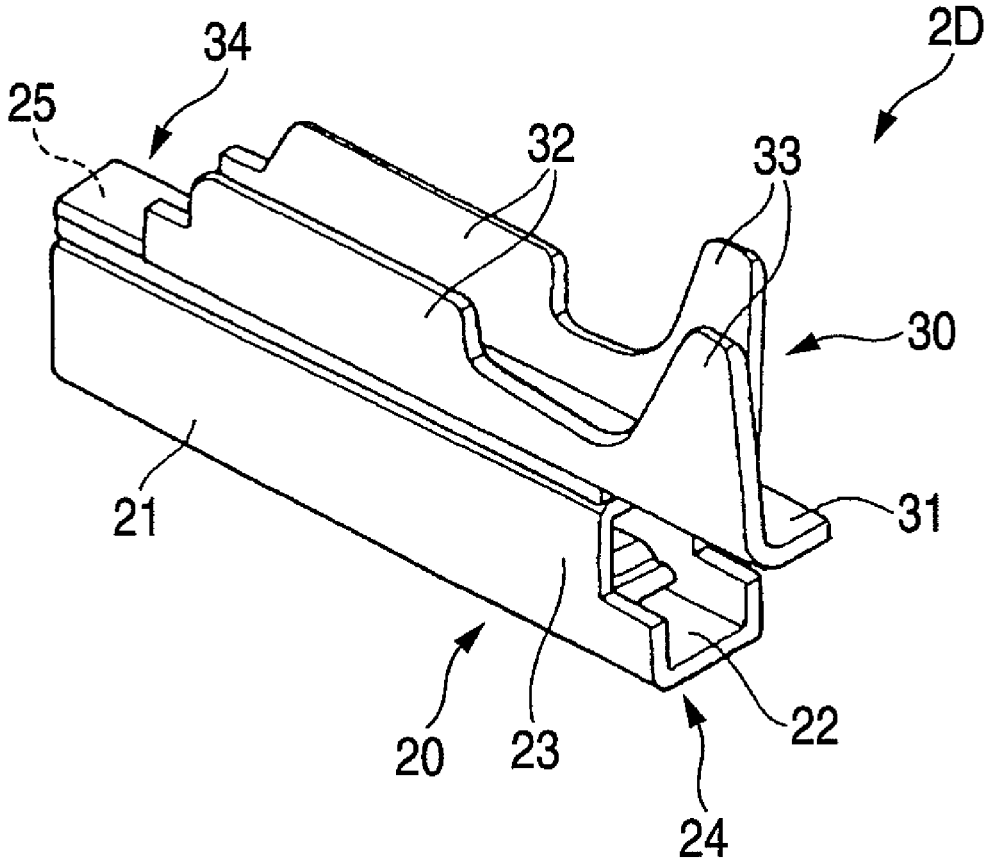
FIG. 8 is a perspective view which explains a modified example of the terminal metal shown in FIGS. 4A and 4B.

In addition, while the terminal metals 1A, 1B, 1C, 2A, 2B, 2C are formed by connecting the connecting portions 14, 24 of the electric contact parts 10, 20 and connecting portions 34, 44, 54 of the wire connection parts 30, 40, 50 together in the first embodiment, in the terminal metals of the invention, as with a terminal metal 2D shown in FIG. 8, a female contact portion 20 and a clamp portion 30 may be connected together by superposing a bottom wall 31 of the clamp portion 30 on a ceiling wall 25 of the female contact portion 20, or a female contact portion 20 and a crimp portion 40 may be connected together by superposing a bottom wall 41 of the crimp portion 40 on a ceiling wall 25 of the female contact portion 20. Of course, a female contact portion 20 and a piercing portion 50 may be connected together by superposing a bottom wall 51 of the piercing portion 50 on a ceiling wall 25 of the female contact portion 20.

Furthermore, the gist of the invention resides in the stabilization of the performance of products by part sharing and reduction in the production costs by virtue of mass production effect, and therefore, the electric contact parts 10, 20 and the wire connection parts 30, 40, 50 are not necessarily formed all. Namely, only one of the electric contact parts 10, 20, for example, only the male contact portion 10 may be formed so as to be connected with any of the wire connection parts 30, 40, 50 which is selected therefrom according to an application, or only the female contact portion 20 may be formed so as to be connected with any of the wire connection parts 30, 40, 50 which is selected therefrom according to an application. Alternatively, only one of the wire connection parts 30, 40, 50, for example, only the clamp portion 30 may be formed so as to be connected with either of the electric contact parts 10, which is selected according to an application. Additionally, needless to say, other wire connection parts having different shapes from those of the wire connection parts 30, 40, 50 described in the first embodiment may be formed so as to be connected with either of the electric contact parts 10, 20 which is selected according to an application.

Furthermore, while the connecting portion 14, 24 of the electric contact part 10, 20 and the connecting portion 34, 44, 54 of the wire connection part 30, 40, 50 are superposed on each other in the connecting method of the first embodiment, in the terminal metals 1A, 1B, 1C, 2A, 2B, 2C of the invention, a projection is provided on one of the connecting portions which are superposed on each other, and a hole is provided on the other, whereby the projection may be fitted in the hole for connection. Namely, the electric contact parts 10, 20 and the wire connection parts 30, 40, 50 may be connected to each other using other connecting methods such as so-called interference fit and fastening utilizing eyelets.

Second Embodiment

Hereinafter, a terminal metal and a method for forming the terminal metal according to a second embodiment of the invention will be described by reference to FIGS. 9A to 14B. The terminal metal manufacturing method according to the second embodiment is a method for forming a terminal metal such as a clamp terminal 101A (shown in FIGS. 9A and 9B) having a male electric contact part (hereinafter, referred to as a male contact portion) 110, and a crimp terminal 101B (shown in FIGS. 10A and 10B) having the male contact portion 110, and a clamp terminal 102A (shown in FIGS. 11A and 11B) having a female electric contact part (hereinafter, referred to as a female contact portion) 120, and a crimp terminal 202B (shown in FIGS. 12A and 12B) having the female contact portion 120.

Note that the same reference numerals will be imparted to the constituent portions that is similar to those of the first embodiment, and the description thereof will be omitted.

Figure 9A:
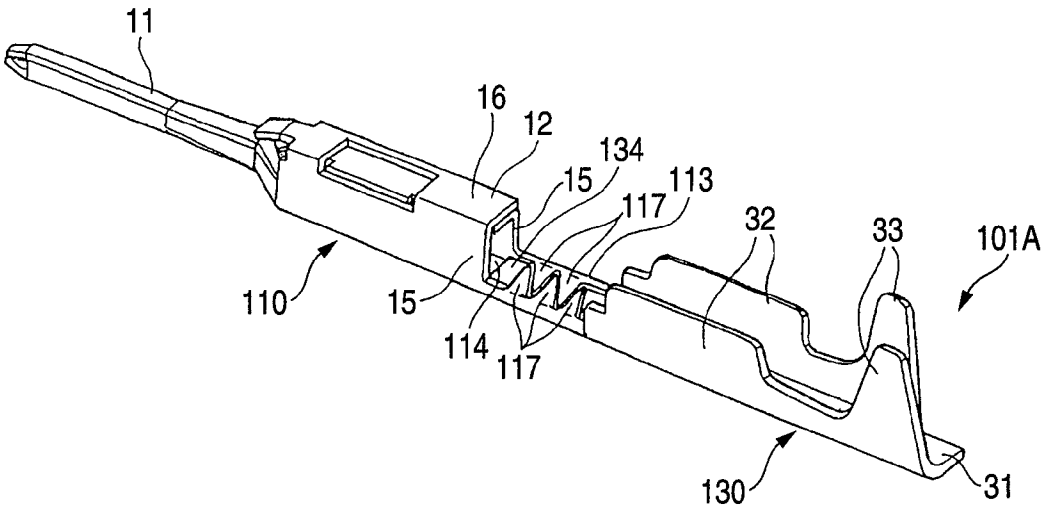
FIG. 9A is a perspective view which shows a clamp terminal having a male contact portion according to a second embodiment of the invention.
Figure 9B:
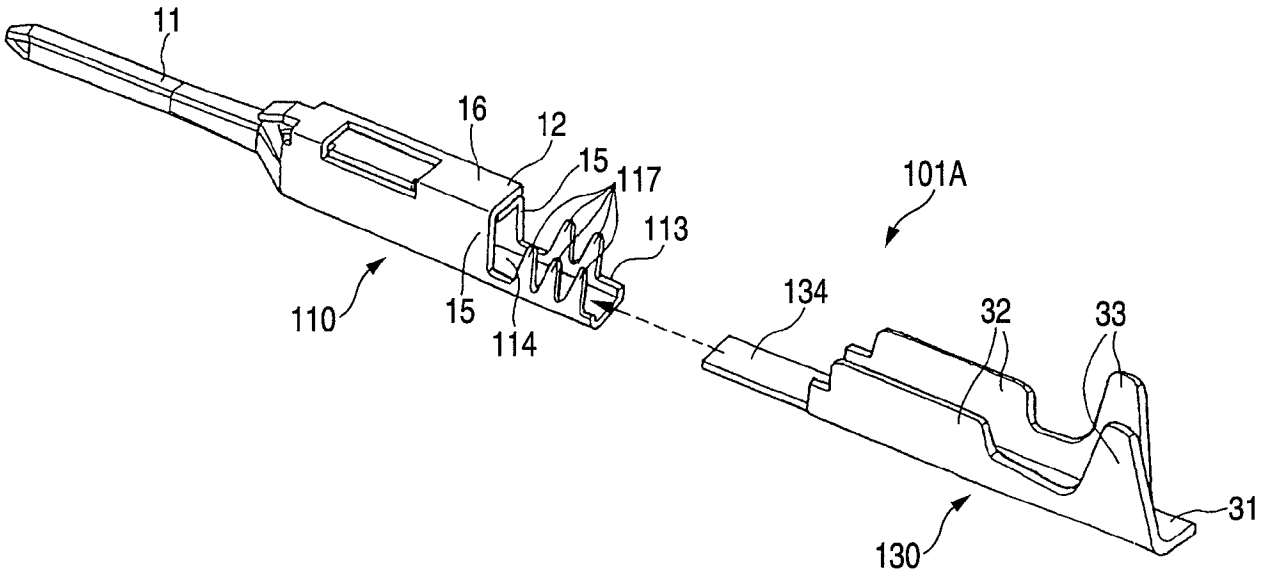
FIG. 9B is an exploded perspective view of the clamp terminal shown in FIG. 9A.

In the second Embodiment, the male contact portion 110 is made of a conductive metal or the like, is formed separately from the clamp portion 130, as shown in FIGS. 9A and 9B and includes an insertion element 11 which is inserted into a female contact portion housed in a mating terminal metal, a main body portion 12 and a connecting portion 113.

The connecting portion 13 continues to a bottom wall 114 at the other longitudinal end of the main body portion 12. A plurality of piercing pieces 117 are projected on both edge portions in width direction of the bottom wall 114. The piercing pieces 117 are disposed along the longitudinal direction of the male contact portion 110 so as to be opposed in a staggered manner on both edges across the width direction of the male contact portion 110. The connecting portion 113 is connected to a connecting portion 134 of a clamp portion 130 (described later).

The male contact portion 110 described foregoing can be used for connecting with the flat cables. In that case, the piercing pieces 117 are brought into contact with conductive bodies of the flat cables like FFC by piecing (passing through) the conductive bodies. Further the distal ends of the piercing pieces 117 piercing the conductive bodies are folded on inner sides toward each other, so that the flat cables are crimped. Thus, the male contact portion 110 and the flat cables are connected electrically and mechanically.

In the clamp terminal 101A, as shown in FIG. 9B, the connecting portion 134 of the clamp portion 130 is superposed on the bottom wall 114 in the connecting portion 113 of the male contact portion 110, and the connecting portion 134 of the clamp portion 130 is clamped by folding distal ends of piecing pieces 117 on inner sides toward each other. Thus, the male contact portion 110 and the clamp portion 30 are connected to each other electrically and mechanically. As described above, in the clamp terminal 101A, the insertion element 11, the main body portion 12 and the connecting portion 113 are aligned in a row in that order.

Figure 10A:
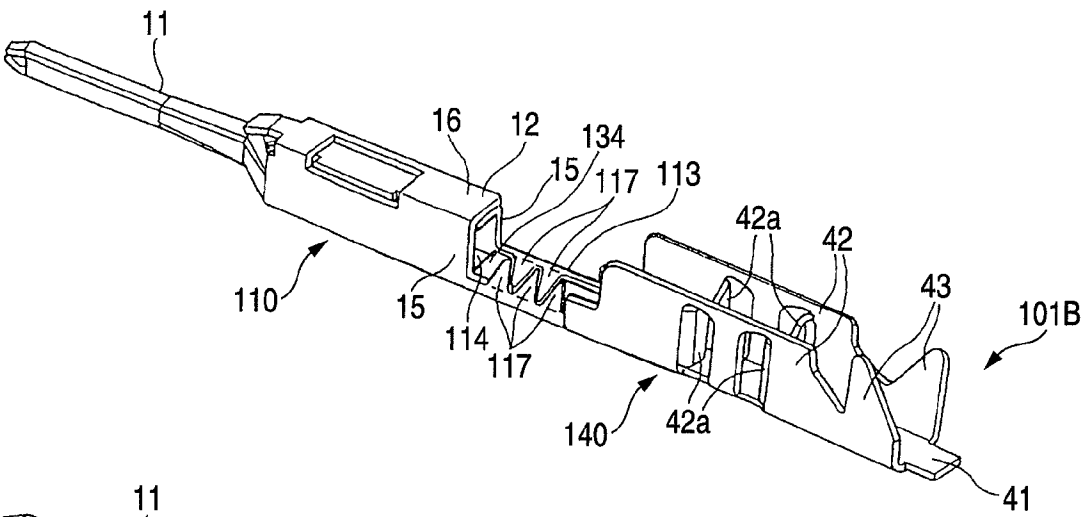
FIG. 10A is a perspective view which shows a crimp terminal having a male contact portion according to the second embodiment of the invention.

The crimp terminal 101B includes, as shown in FIG. 10A, a male contact portion 110 and a press connecting portion 140 as a wire connection part where an electric wire is connected electrically. The same male contact portion as the male contact portion 110 of the clamp terminal 1A is used as the male contact portion 110.

In the crimp terminal 101B, the crimp portion 140 includes further a connecting portion 144. The connecting portion 144 is provided at an end of the bottom wall 41 which adjoins the pressure connecting pieces 42 and extends longitudinally from the bottom wall 41.

In the crimp terminal 11B, the male contact portion 110 is connected to the connecting portion 144 of the crimp portion 140 at the connecting portion 113.

Figure 10B:
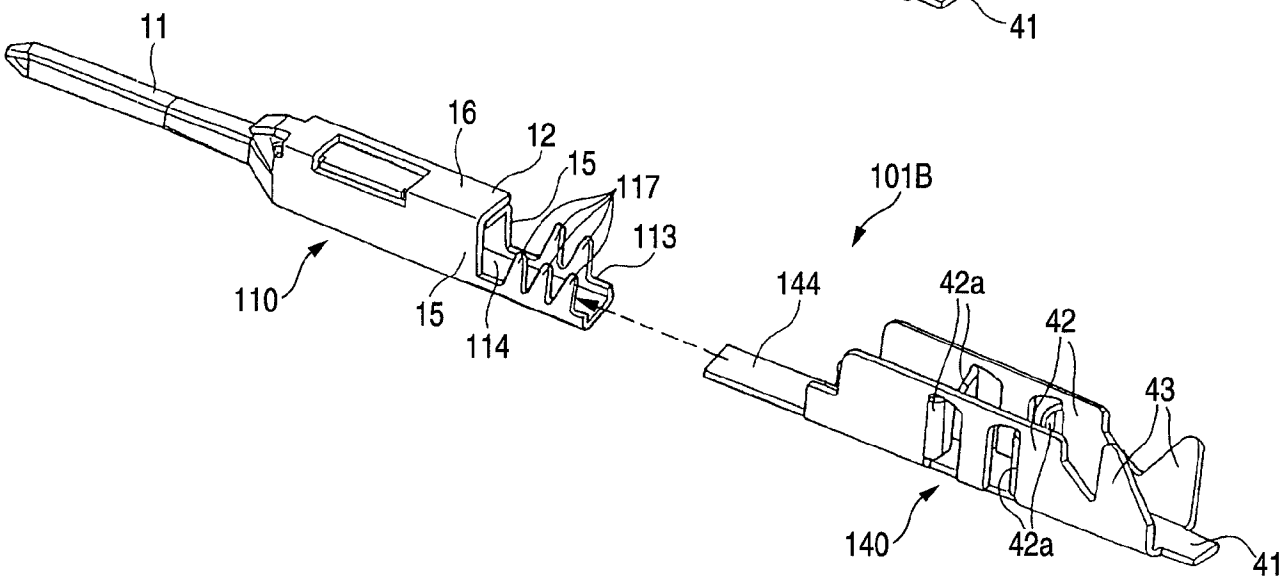
FIG. 10B is an exploded perspective view of the crimp terminal shown in FIG. 10A.

In the crimp terminal 101B, as shown in FIG. 10B, the connecting portion 144 of the crimp portion 140 is superposed on the bottom wall 114 in the connecting portion 113 of the male contact portion 110, and the connecting portion 144 of the crimp portion 140 is crimped by folding distal ends of piecing pieces 117 on inner sides toward each other. Thus, the male contact portion 110 and the crimp portion 140 are connected to each other electrically and mechanically. In the crimp terminal 101B, the insertion element 11, the main body portion 12 and the crimp portion 140 are aligned in a row in that order.

Figure 12A:
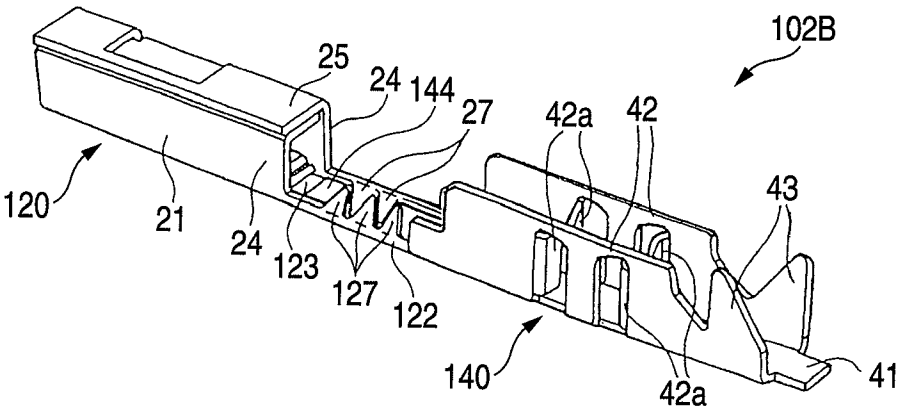
FIG. 12A is a perspective view which shows a crimp terminal having a female contact portion according to the second embodiment of the invention.

The clamp terminal 102A includes, as shown in FIG. 12A, a female contact portion 120 and a clamp portion 130 as a wire connection part to which an electric wire is connected electrically. The same clamp portion as the clamp portion 130 of the clamp terminal 101A is used as the clamp portion 130.

Figure 11A:
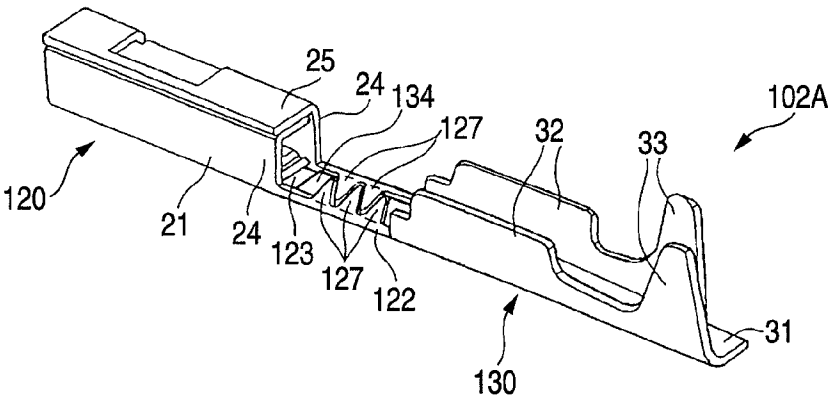
FIG. 11A is a perspective view which shows a clamp terminal having a female contact portion according to the second embodiment of the invention.
Figure 11B:
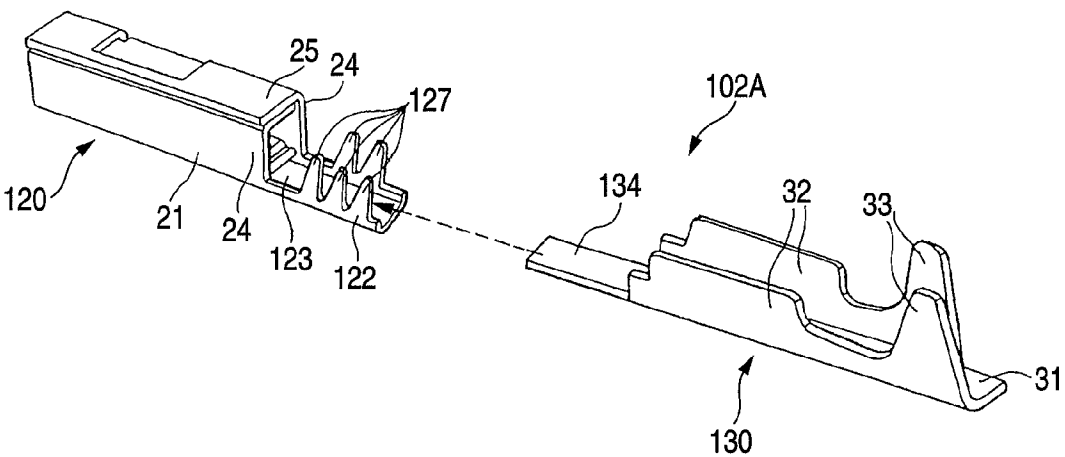
FIG. 11B is an exploded perspective view of the clamp terminal shown in FIG. 11A.

The female contact portion 120 is made of a conductive metal or the like and includes, as shown in FIGS. 11A and 11B, a tubular portion 21 which is formed separately from the clamp portion 130 and is adapted to accommodate therein an insertion element of a mating terminal metal, a spring piece, not shown, and a connecting portion 122.

The connecting portion 22 continues to a bottom wall 123 at the other longitudinal end of the tubular portion 21. A plurality of piercing pieces 127 are projected on both edge portions in width direction of the bottom wall 123. The piercing pieces 127 are disposed along the longitudinal direction of the female contact portion 20 so as to be opposed in a staggered manner on both edges across the width direction of the female contact portion 120. The connecting portion 122 is connected to the connecting portion 134 of the clamp portion 130.

The female contact portion 120 described foregoing can be used for connecting with the flat cables. In that case, the piercing pieces 127 are brought into contact with conductive bodies of the flat cables like FFC by piecing (passing through) the conductive bodies. Further the distal ends of the piercing pieces 127 piercing the conductive bodies are folded on inner sides toward each other, so that the flat cables are crimped. Thus, the female contact portion 120 and the flat cables are connected electrically and mechanically.

In the clamp terminal 102A, as shown in FIG. 11B, the connecting portion 134 of the clamp portion 130 is superposed on the bottom wall 123 in the connecting portion 122 of the female contact portion 120, and the connecting portion 134 of the clamp portion 130 is crimped by folding distal ends of piecing pieces 127 on inner sides toward each other. Thus, the female contact portion 120 and the clamp portion 130 are connected to each other electrically and mechanically. In the clamp terminal 102A, the tubular portion 21, the connecting portion 122 and the clamp portion 130 are aligned in a row in that order.

The crimp terminal 102B includes, as shown in FIG. 12A, a crimp portion 140 as a wire connection part where an electric wire is connected electrically and a female contact portion 120. The same female contact portion as the female contact portion 120 of the clamp terminal 102A is used as the female contact portion 120, and the same crimp portion as the crimp portion 140 of the pressure terminal 101B is used as the crimp portion 140.

Figure 12B:
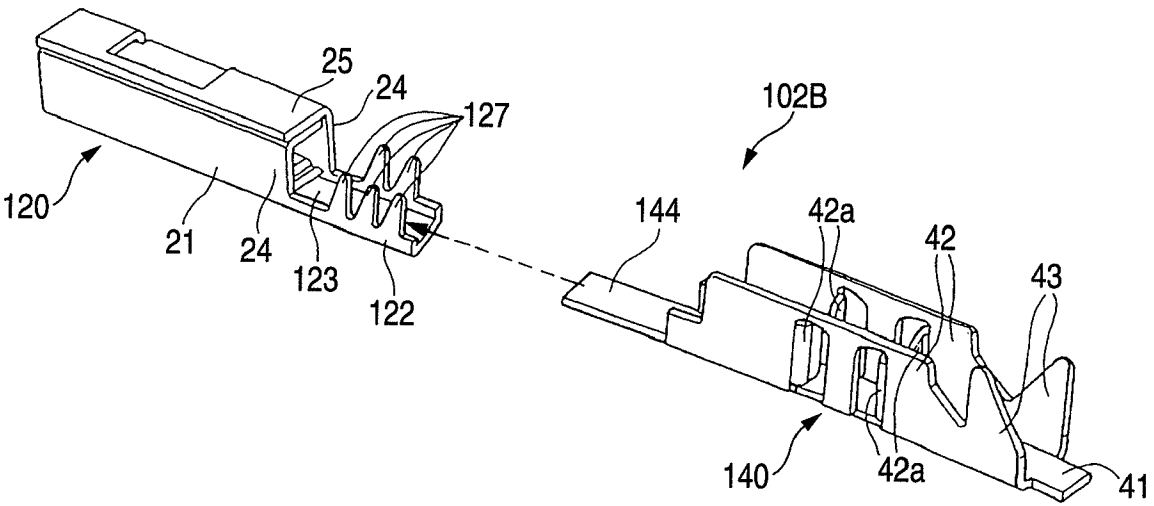
FIG. 12B is an exploded perspective view of the crimp terminal shown in FIG. 12A.

In the clamp terminal 102B, as shown in FIG. 12B, the connecting portion 144 of the crimp portion 140 is superposed on the bottom wall 123 in the connecting portion 122 of the female contact portion 120, and the connecting portion 144 of the crimp portion 140 is crimped by folding distal ends of piecing pieces 127 on inner sides toward each other. Thus, the female contact portion 120 and the crimp portion 140 are connected to each other electrically and mechanically. In the crimp terminal 102B, the tubular portion 21, the connecting portion 122 and the crimp portion 140 are aligned in a row in that order.

Figure 13:
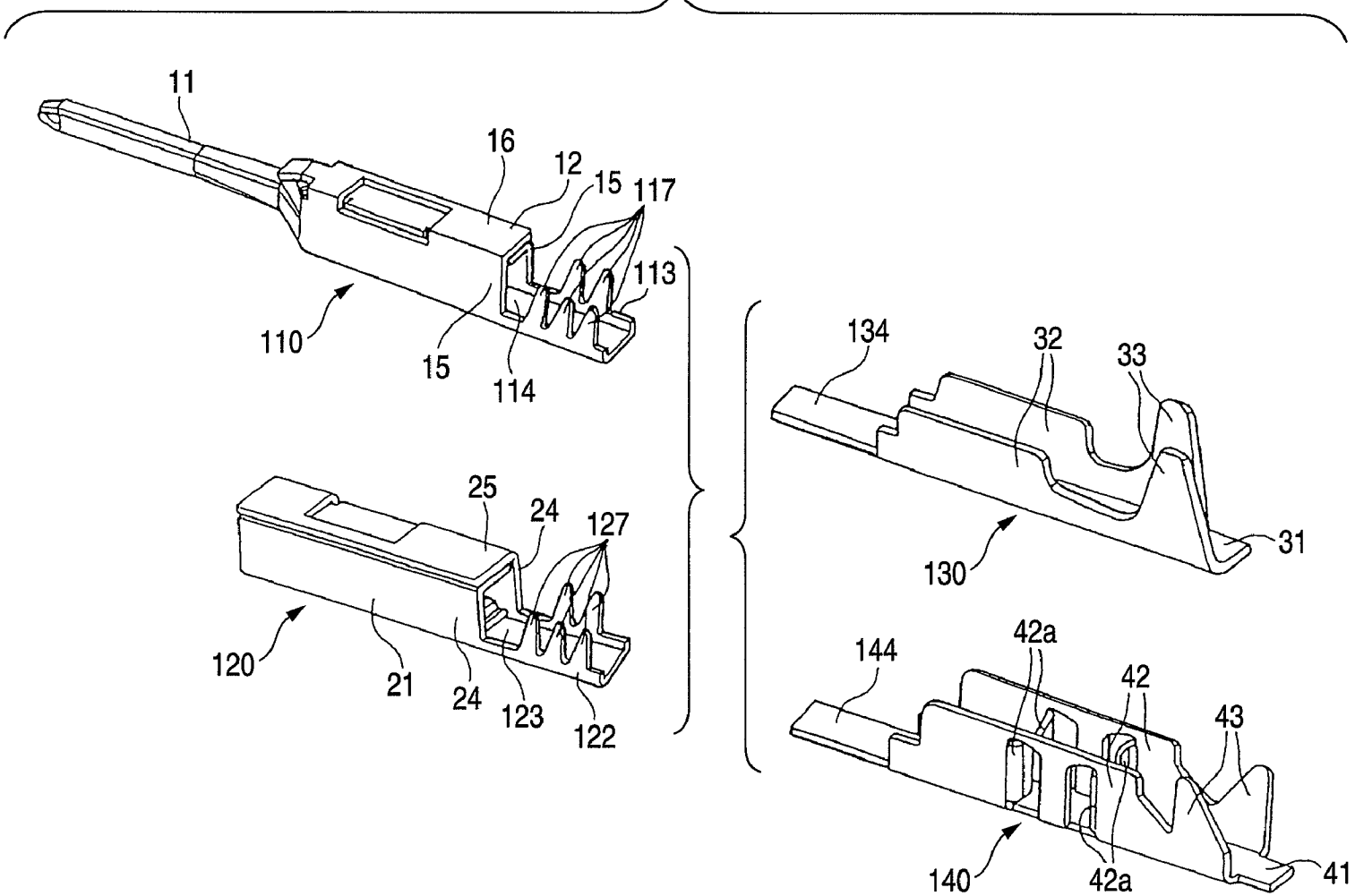
FIG. 13 is a perspective view which explains a method for forming the terminal metals shown in FIGS. 9 to 12B.

A method will be described for forming the terminal metals 101A, 101B, 102A and 102B. Firstly, as shown in FIG. 13, the male contact portion 110, the female contact portion 120, the clamp portion 130 and the crimp portion 140 are formed separately from each other. These are formed by bending sheets metal obtained by stamping conductive sheets metal with dies.

Next, one of the male contact portion 110 and the female contact portion 120 and one of the clamp portion 130 and the crimp portion 140 are selected according to an application, and the connecting portion 113, 122 of the selected electric contact part 110, 120 and the connecting portion 134, 144 of the selected wire connection part 130, 140, are superposed, and the connecting portion 134, 144 of the selected wire connection part 130,140 are clamped by folding a plurality of piercing pieces 117, 127 toward. Thus the electric contact part 110, 120 and the wire connection part 130, 140 are connected electrically and mechanically, and, the terminal metals 101A, 101B, 102A, 102B of the second embodiment are formed.

Thus, according to the terminal metals 101A, 101B, 102A, 102B and the method for forming the terminal metals 101A, 101B, 102A, 102B of the second embodiment, since the parts 110, 120, 130, 140 which make up the terminal metals 101A, 101B, 102A, 102B which are to be formed under different product numbers can be shared between the terminal metals 101A, 101B, 102A, 102B, the variation in performance inherent in the conventional terminal metals can be minimized, and the production costs of the terminal metals 101A, 101B, 102A, 102B, can be reduced by virtue of mass production effect. Further, the electric contact part 110, 120 itself can be used as a piercing terminal, product numbers can be reduced.

Figure 14A:
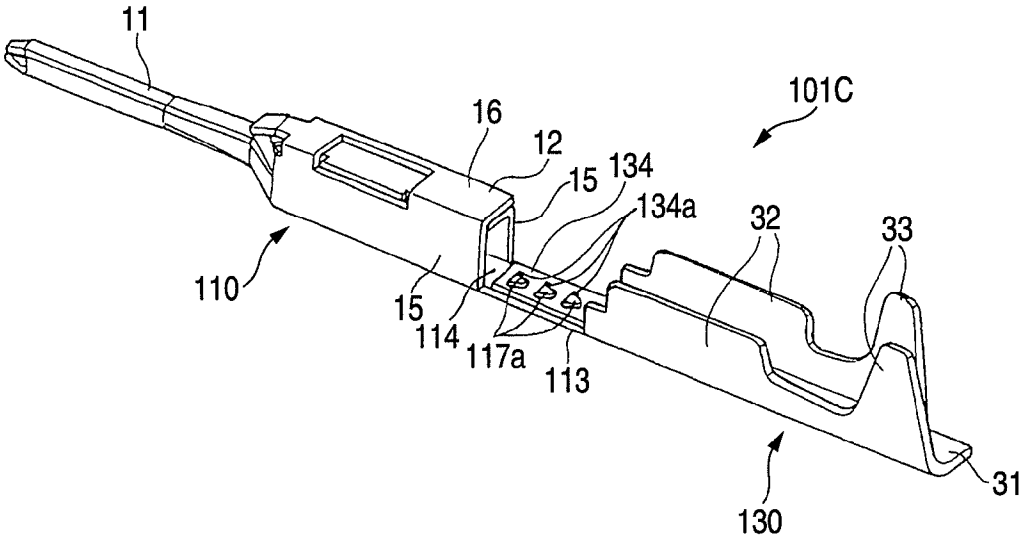
FIG. 14 is a perspective view which explains a modified example of the terminal metal shown in FIGS. 9A and 9B.
Figure 14B:
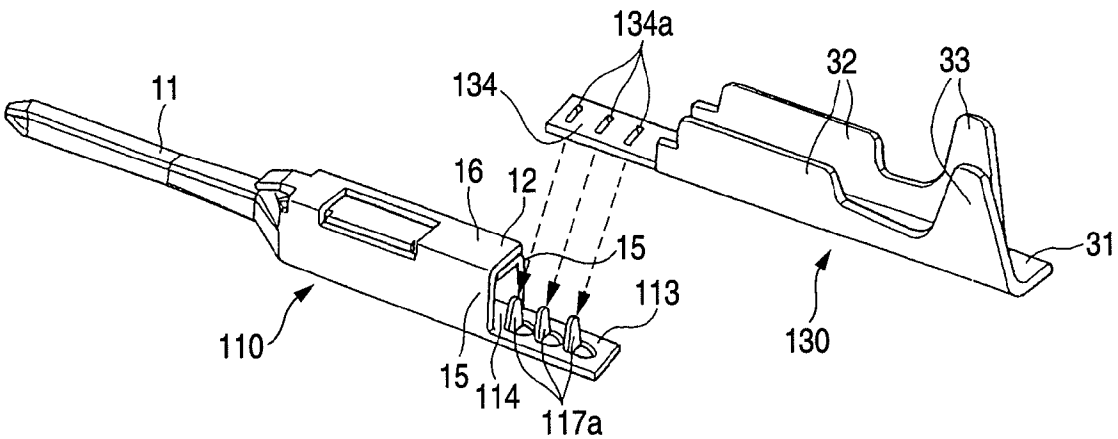

In addition, while the connection portion 134, 144 of the wire connection part 130, 140 is crimped by folding the distal ends of the piercing pieces 117, 127 provided on the connecting portion 113, 122 of the electric contact part 110, 120 on the inner sides toward each other in the second embodiment, in the terminal metals of the invention, as with a terminal metal 101C shown in FIG. 14A, a plurality of piercing pieces 117*a*(shown in FIG. 14B) are provided by punching the bottom wall 114 of the male contact portion 110, and a plurality of slits 134*a* capable of passing the piercing pieces 117*a* are formed in the connecting portion 134 of the clamp portion 130, the connecting portion 134 of the clamp portion 130 may be crimped by folding the piercing pieces 117*a* toward the bottom wall 114 after passing the piercing pieces 117*a* through the slits 134*a*.

To connect between the electric contact part 110, 120 and the wire connection part 130, 140, after the connecting portion 113, 122 of the electric contact part 110, 120 and the connecting portion 134, 144 of the wire connection part 130, 140 are connected to each other by an ultrasonic bonding method, a spot welding method and the like, the connecting portion 134, 144 of the wire connection part 130, 140 may be crimped with the piercing pieces 117, 127. By this structure, the connection strength between the electric contact part 110, 120 and the wire connection part 130, 140 can be increased.

Further, the connection treatment between the electric contact part 110, 120 and the wire connection part 130, 140 may be performed after the wire connection part 130, 140 is connected to the wire, or before it is connected to the wire or at the same time when it is connected to the wire. Incidentally, by performing the connecting treatment after the wire connection part 130, 140 is connected to the wire, the breakage or deformation of the electric contact part 110, 120 can be prevented at the time when the wire is connected to the wire connection part 130, 140 in the wire harness manufacturing process.

Furthermore, the gist of the invention resides in the stabilization of the performance of products by part sharing and reduction in the production costs by virtue of mass production effect, and therefore, the electric contact parts 110, 120 and the wire connection parts 130, 140 are not necessarily formed all. Namely, only one of the electric contact parts 110, 120, for example, only the male contact portion 110 may be formed so as to be connected with any of the wire connection parts 130, 140 which is selected therefrom according to an application, or only the female contact portion 120 may be formed so as to be connected with any of the wire connection parts 130, 140 which is selected therefrom according to an application. Alternatively, only one of the wire connection parts 130, 140 for example, only the clamp portion 130 may be formed so as to be connected with either of the electric contact parts 110, 120 which is selected according to an application. Additionally, needless to say, other wire connection parts having different shapes from those of the wire connection parts 130, 140 described in the second embodiment may be formed so as to be connected with either of the electric contact parts 110, 120 which is selected according to an application.

Note that the first and second embodiments that have been described heretofore only illustrate the modes which represent the invention, and hence the invention is not limited to these embodiment. Namely, various modifications may be made thereto without departing from the sprit and scope of the invention.

The invention claimed is:

1. A manufacturing method of a terminal metal comprising a wire connection part to which an electric wire is connected and an electric contact part which is electrically connected to a mating terminal metal, comprising the steps of:

forming separately a wire connection part and an electric contact part; and fitting said wire connection part and said electric contact part to each other, so that the terminal metal is formed, wherein said wire connection part is selected from plural types of parts, and the selected wire connection part is joined to said electric contact part;

wherein said wire connection part includes a clamp portion where an electric wire is clamped, a crimp portion where an electric wire is crimped and a piercing portion where an electric wire is pierced to be crimped.

2. A manufacturing method of a terminal metal according to claim 1, wherein said wire connection part and said electric wire part are joined to each other by crimping a piecing piece that is provided in one of said wire connection part and said electric wire part.

3. A terminal metal comprising:

a wire connection part to which an electric wire is connected; and an electric contact part which is electrically connected to a mating terminal metal;

wherein said wire connection part and said electric contact part are separately formed and joined to each other;

wherein said wire connection part is selected from plural types of parts capable of being fitted to the electric contact part;

the selected wire connection part is joined to the electric contact part; and wherein said wire connection part includes a clamp portion where an electric wire is clamped, a crimp portion where an electric wire is crimped and a piercing portion where an electric wire is pierced to be crimped.

4. A terminal metal according to claim 3, wherein said wire connection part and said electric wire part are joined to each other by crimping a piecing piece that is provided in one of said wire connection part and said electric wire part.

* * * * *